US010384839B2

(12) United States Patent
Yamaguchi

(10) Patent No.: US 10,384,839 B2
(45) Date of Patent: Aug. 20, 2019

(54) UNIVERSAL FIT BOTTLE CAP

(71) Applicant: Chad Yamaguchi, Honolulu, HI (US)

(72) Inventor: Chad Yamaguchi, Honolulu, HI (US)

( * ) Notice: Subject to any disclaimer, the term of this patent is extended or adjusted under 35 U.S.C. 154(b) by 0 days.

(21) Appl. No.: 14/996,868

(22) Filed: Jan. 15, 2016

(65) Prior Publication Data

US 2016/0325892 A1 Nov. 10, 2016

Related U.S. Application Data

(60) Provisional application No. 62/080,280, filed on Nov. 15, 2014.

(51) Int. Cl.
*B65D 47/08* (2006.01)
*B65D 41/04* (2006.01)
*B65D 47/32* (2006.01)

(52) U.S. Cl.
CPC ..... *B65D 47/0857* (2013.01); *B65D 41/0442* (2013.01); *B65D 47/32* (2013.01)

(58) Field of Classification Search
CPC ..... B65D 41/0442; B65D 47/0857; B65D 47/32; B65D 2251/08
See application file for complete search history.

(56) References Cited

U.S. PATENT DOCUMENTS 3,784,045 A * 1/1974 Komendowski ..... B65D 1/0238 215/344
3,827,593 A * 8/1974 Kramb ..... B65D 50/063 215/208
5,573,281 A * 11/1996 Keller ..... B05C 17/00506 222/566
6,196,413 B1 * 3/2001 Tung ..... B65D 47/0885 215/229
7,328,820 B2 * 2/2008 Young ..... B65D 47/0838 215/235
8,365,968 B2 * 2/2013 Yoon ..... B65D 47/241 222/507
2005/0133546 A1 * 6/2005 Carvalho ..... A61J 9/04 222/481.5
2007/0262041 A1 * 11/2007 Smith ..... A61J 9/008 215/11.5
2012/0323221 A1 * 12/2012 Gallo ..... A61M 3/0279 604/514
2016/0325892 A1 * 11/2016 Yamaguchi ..... B65D 47/0857

* cited by examiner

*Primary Examiner* — David P Angwin
*Assistant Examiner* — Bob Zadeh
(74) *Attorney, Agent, or Firm* — Thorpe North & Western LLP

(57) ABSTRACT

A bottle cap assembly that includes a base portion that is releasably connected to a container. The base portion includes a top surface, a skirt portion having an inner surface, a breather hole formed in the top surface, a nozzle extending from the top surface, a plurality of female threads positioned on the inner surface of the skirt portion, and a plurality of gaps formed in the female threads along the length thereof. The plurality of female threads and associated gaps are operable to mate with male threads of at least two different containers to releasably connect the bottle cap assembly to the at least two different containers.

18 Claims, 6 Drawing Sheets

UNIVERSAL FIT BOTTLE CAP

CROSS-REFERENCE TO RELATED APPLICATION

The present application claims the benefit of U.S. Provisional Application No. 62/080,280, filed on 15 Nov. 2014, and entitled "Universal Fit Bottle Cap Straw Lid and Adapter," which application is incorporated herein in its entirety by this reference.

BACKGROUND

The disadvantages of drinking from an open container are well-known, such as for example spilling and contaminating the liquid contents inside the container with ambient germs. Such problems are generally not solved satisfactorily by common lids, since lids still generally have to be removed in order to dispense the contained liquid. Thus, prior art container caps have been created with the objective of avoiding ambient contamination by, for example, avoiding the need to open the cap (e.g., not having to unscrew a lid). Many containers and container lids have been developed in an attempt to achieve similar objectives, and to prevent liquid spilling from the straw when the liquid in the container is not being dispensed, by incorporating a straw/nozzle fixed over the lid of a container, such as a straw/nozzle that flips up when in use and flips down to lay flat horizontally when not in use. Such designs may include a feature for stopping the liquid when the straw is in the horizontal position (e.g., a kink in the straw).

However, the aforementioned genre of containers have normally incorporated a common water bottle design where the lid opening of the container is relatively wide and fairly close to the size of the cross section of the container. For example, for containers with tubular cross sections, the top aperture normally has had a circumference substantially approximate to the cross section. The container lids of the same genre (incorporating straws) were often similarly designed to be placed over similar styles of containers. However, some such features for preventing ambient contamination and/or spillage, such as folding straws/nozzles, while effective for containers with relatively wide lid openings, are much less effective if not obsolete for a different genre of bottles having much smaller top openings. Simply put, there is not enough space (e.g., surface area, etc.) in such smaller bottle apertures to address the problems the same way (e.g., folding straws to kink) as with the containers with larger openings. Consequently, a certain genre of bottle cap designs was created that provided some of the advantages of a cap having a straw/nozzle, such as avoiding to a large degree ambient contamination by not having to remove the lid when dispensing liquid, but for certain bottles with smaller necks.

SUMMARY

The present disclosure relates to bottle caps and other lid mechanisms that control access to the contents of a container such as a bottle. One aspect of the present disclosure relates to a bottle cap assembly that includes a base portion that is releasably connected to a container. The base portion includes a top surface, a skirt portion having an inner surface, a breather hole formed in the top surface, a nozzle extending from the top surface, a plurality of female threads positioned on the inner surface of the skirt portion, and a plurality of gaps formed in the female threads along the length thereof. The plurality of female threads and associated gaps are operable to mate with male threads of at least two different containers to releasably connect the bottle cap assembly to the at least two different containers. The two different containers may include male threads that are different in at least one of size, shape and pattern. Alternatively, the containers may have neck sizes that are slightly different.

The bottle cap assembly may also include a lid portion pivotally mounted to the base portion. The lid portion, when in a closed position relative to the base portion, may enclose the nozzle. The base portion may further include a breather hole formed in the top surface. The lid portion may include a sealing member configured to close the breather hole when the lid portion is in the closed position. The lid portion may be connected to the base portion with a pivot connection. The lid portion and the base portion may include mating snap-fit connection features that are operable to releasably hold the lid portion in the closed position. The nozzle may be integrally formed with the top surface. The plurality of threads may include two threads. The plurality of gaps may include at least 4 gaps. The skirt may have an internal diameter in the range of about 0.5 inches to about 3 inches, and the bottle cap assembly may be configured to mount to necks of the at least two containers having diameter sizes in the range of 0.5 inches to about 3 inches. The skirt may have an internal diameter in the range of about 0.5 inches to about 1.5 inches, and the bottle cap assembly may be configured to mount to necks of the at least two containers having diameter sizes in the range of 0.5 inches to about 1.5 inches.

The above summary is not intended to describe each embodiment or every implementation of embodiments of the present disclosure. The Figures and the detailed description that follow more particularly exemplify one or more preferred embodiments.

BRIEF DESCRIPTION OF THE FIGURES

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
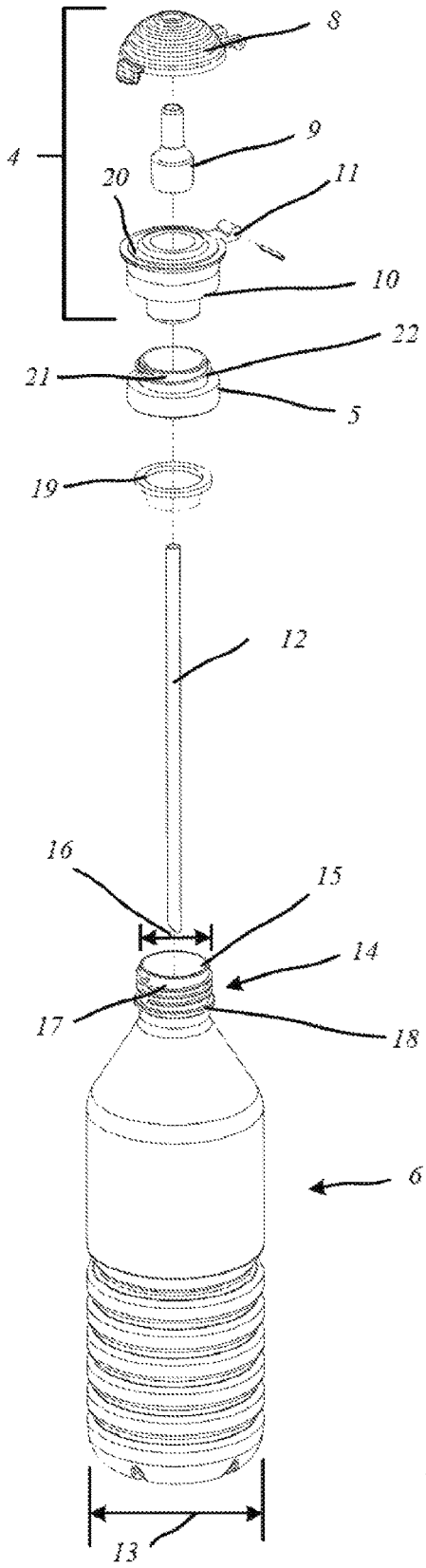
FIG. 1 is a perspective view of the parts of one embodiment of a universal fit bottle cap and adapter, suction free nozzle and a container in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure relates to bottle caps, and more particularly relates to bottle caps that are operable on a variety of bottle shapes, sizes and designs. One aspect of the present disclosure relates to bottle caps, particularly those that include a straw and/or nozzle, that are designed for use with bottles having a top aperture substantially less wide than the cross section of standard wide-mouth bottles. More specifically, the present disclosure provides for improvement related to bottle caps for certain bottles having a top diameter less than one and one half inch, which design for example, limits transverse area in which a straw could fold.

By way of example and not by limitation, many commercially available disposable (and often recyclable) bottled water containers and certain plastic beverage containers incorporate such bottle designs with narrower bottle necks and top apertures with a diameter of less than about one and one half inch. Although the aforementioned bottle cap with a folding straw may be effective at achieving its intended objective to prevent ambient contamination of the liquid inside such containers while dispensing the liquid, the design also has certain disadvantages that are overcome by embodiments of the bottle caps disclosed herein.

More specifically, prior art bottle caps having straws and/or nozzles for containers with smaller apertures generally attach to the container with a cap having an interior surface with specifically designed female threads that are configured to threadably engage with specifically designed male threads on the external surface of the bottle. Since numerous male thread designs exist for different bottles (e.g., varying for manufacturer, type of drink, etc.), it is difficult to provide a cap that is usable with more than one male thread design. Although bottle neck diameters may generally fall within a substantially close range of sizes, different bottles nevertheless may have bottle necks of different dimensions, material, and thread designs.

Known bottle caps have the limitation of not being able to attach to bottles having a bottle neck with an external surface with different male threads designs (e.g., patterns or sizes) not compatible with the female thread design of the interior surface of the prior art cap. Moreover, some prior art caps might fit over certain patterns or sizes of male threads, but not securely connect with the bottle and/or male threads, and might even become detached from the bottle when internal or external forces are applied. Existing solutions generally require a unique bottle cap having an internal size and female thread design that is specifically designed for each bottle and associated male thread design. The bottle caps of the present disclosure address this issue by providing a bottle cap capable of being releasable secured to many different bottles and associated male thread designs, and particularly bottles having relatively narrow bottle necks. The bottle caps of the present disclosure may be referred to as a "universal fitting" bottle cap because of its capability to mount to a variety bottle shapes, sizes, thread designs, etc.

In one embodiment, a cap portion of a bottle cap assembly may be configured to receive and/or mount a straw or nozzle, and may also connect with bottles having several different sized necks and thread designs. This may be accomplished using a female thread design on the interior of the cap portion that includes a plurality of gaps formed along the length of the threads. These gaps may be referred to herein as points of entry. Another embodiment may comprise an adapter connectable to the cap portion that permits the bottle cap to connect to even more bottles shapes, sizes and male thread designs. In certain embodiments, both the adapter and the cap portion include additional points of entry as compared to typical female threads and may permit the cap portion to be more reliably secured to a bottle.

Turning to the figures, FIG. 1 illustrates a perspective view of the parts of a universal fit bottle cap 4, adapter 5, and container 6 for holding and dispensing liquid. The universal fit bottle cap 4 and adapter 5 may be secured to the container 6. The universal fit bottle cap 4 may be comprised of a lid 8, a nozzle 9, a bottle cap 10, a pivot connector 11 for opening and closing the lid 8, and a straw 12 for dispensing liquid from the container 6. The bottle cap 10 may have a top surface 20 to which the nozzle 9 may attach. The container 6 may have a width 13 and a bottle neck 14 having a top end with an aperture 15 and a width 16 that is substantially narrower that the container's width 13. The bottle neck 14 may also have an external surface 17 having particularly sized male threads 18. A washer 19 may also be inserted either between either the adapter 5 or the bottle cap 10 and the top end of the bottle neck 14.

The adapter 5 may have an exterior surface 21 comprising male threads 22, which may allow the adapter 5 to be secured to the bottom of the bottle cap 10. More specifically, male threads 22 of the adapter 5 may, as shown in FIG. 2, be aligned to fit the female threads 23 found along the interior surface 24 of the bottle cap 10 (see FIG. 2).

When the adapter 5 is not secured to the bottom of the bottle cap 10, the bottle cap 10 may also be used to attach to several different containers similar to the container 6 shown, but with several different configurations of male thread designs other than the male thread 18 design shown. More specifically, the female threads 23 found along the interior surface 24 of the bottle cap 10 may also be used to fit over several different male threads designs. In the embodiment shown, this may be accomplished by multiple gaps 25 in the thread design, which are also referred to herein as ports of entry 25. In one embodiment, the interior surface 24 of the bottle cap 10 may comprise several rings of thread 26, 27 (see FIG. 2) and the ports of entry 25 may be found in each thread ring 26, 27. The ports of entry 25 of each thread ring 26, 27 may be aligned vertically. The aforementioned design of the bottle cap 10 may also allow a more secure attachment to a container 6 than designs with just a single thread ring.

Figure 2:
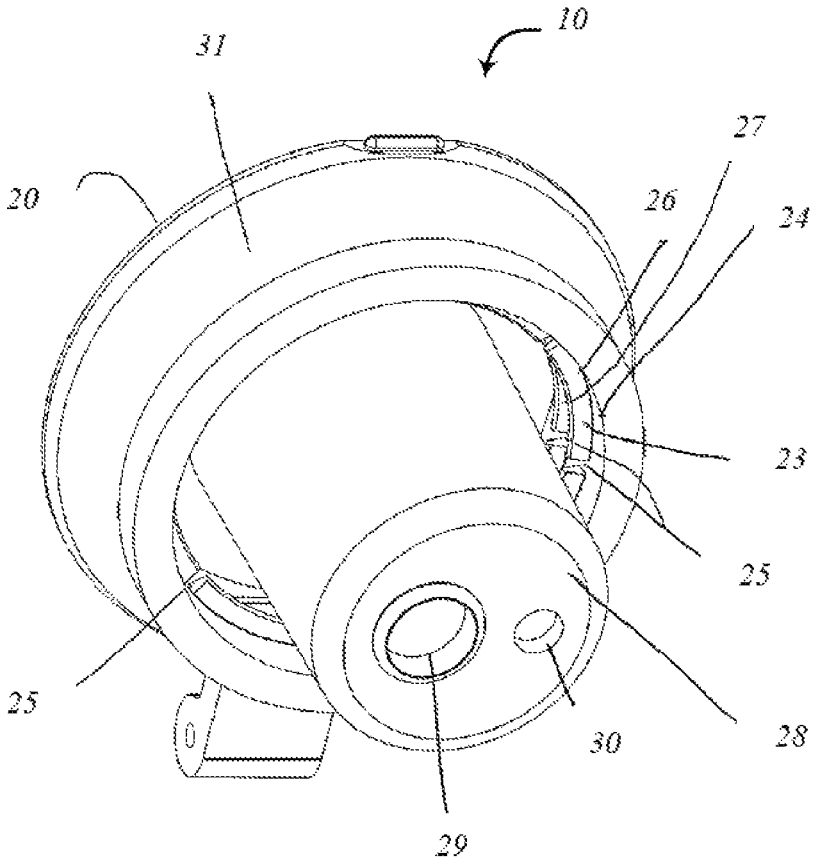
FIG. 2 is a bottom perspective view of the bottom of the universal fit bottle cap of FIG. 1 and showing a suction-preventing air hole.
Figure 3A:
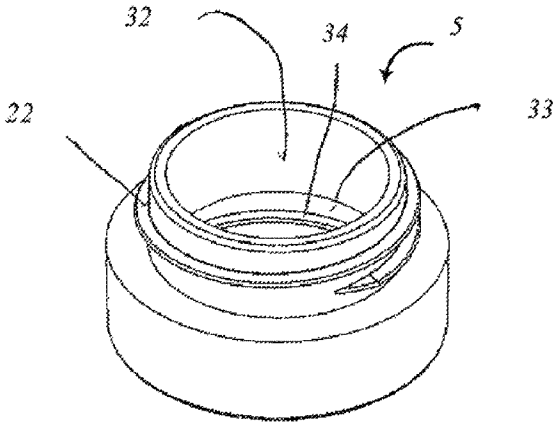
FIG. 3A is a top perspective view of the adapter of FIG. 1.
Figure 3B:
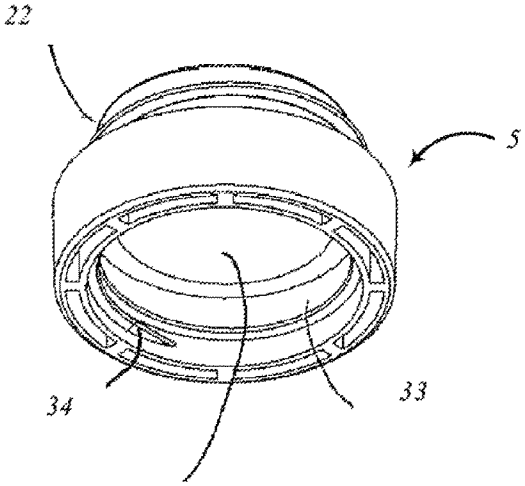
FIG. 3B is a bottom perspective view of the adapter of FIG. 1.
Figure 3C:
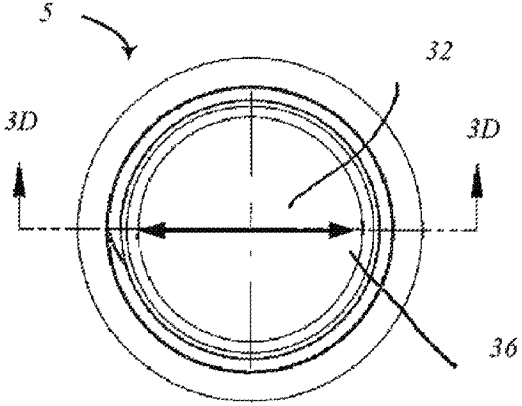
FIG. 3C is a top view of the adapter of FIG. 1.
Figure 3D:
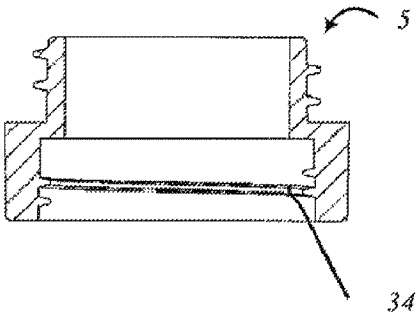
FIG. 3D cross-sectional view of the adapter of FIG. 3C taken along cross-section indicators 3D-3D.

Still referring to FIG. 2, the bottle cap 10 may also comprise a bottom surface 28 and two apertures 29, 30 along the bottom surface 28: one aperture 29 into which the straw 12 (see FIG. 1) may be inserted for dispensing liquid held in the container 6 through the straw 12, bottle cap 10 and nozzle 9 while avoiding ambient contamination. Beneath the top surface 20 of the bottle cap 10 may also be a slightly outwardly protruding top seal 31, which may also assist in preventing ambient contamination of the container 6.

Referring now to FIGS. 3A-3D, the adapter 5 may have a cylindrically hollow interior 32 and an interior surface 33. Along the interior surface 33 may be female threads 34 for threadably engaging the male threads 18 along the external surface 17 of the bottle neck 14 (see FIG. 1). The container male thread 18 design for some certain types of containers may not be compatible to threadably engage with female thread 23 design of the bottle cap 10. A width 36 of the cylindrically hollow interior 32 may be slightly larger than that the width of the top end of the bottle neck 14 of a container 6.

The universal fit bottle cap 4 and the adapter 5, which may be integrated thereto to form a single integrated device 35, may allow attachment (e.g., by threaded engagement) of the universal fit bottle cap 4 to various containers of the type having a top end of a bottle neck 14 having a width less than, for example, about 1.5 inches and having multiple different male thread designs.

FIGS. 4A-6B illustrate another example universal fit bottle cap 400 for connecting to one or more different sized containers (e.g., container 6 shown in FIG. 1). The universal fit bottle cap 400 includes a base portion 402 and a lid portion 404. The base portion 402 and lid portion 404 may be connected to each other, such as by using a pivot connection and latch as shown in at least FIG. 4A.

Figure 4A:
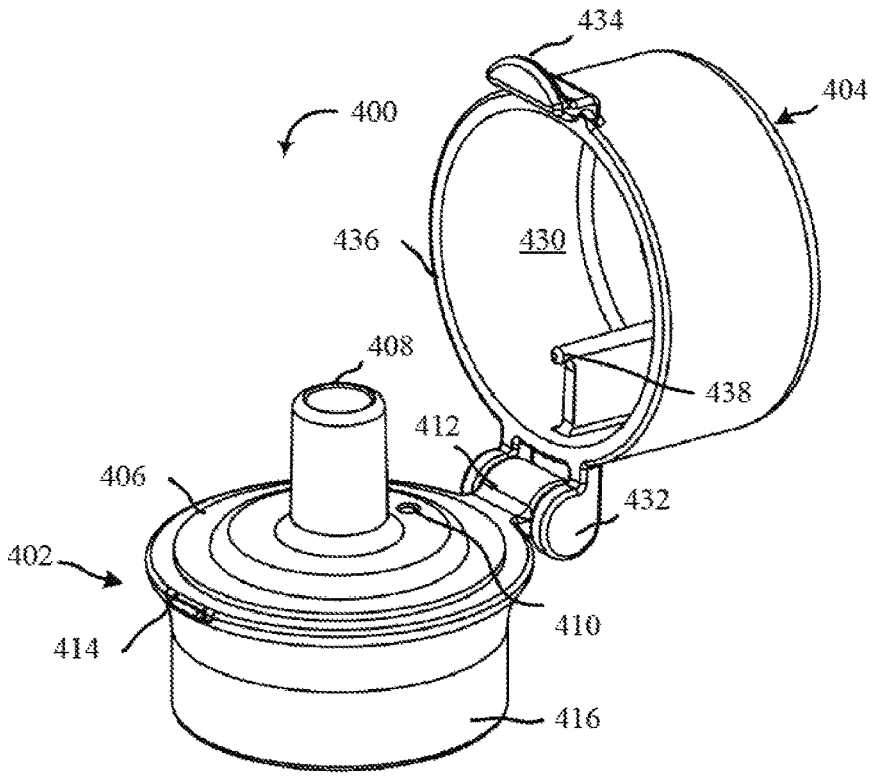
FIG. 4A is a perspective view of an embodiment of a universal fit bottle cap in an open position in accordance with the present disclosure.
Figure 4B:
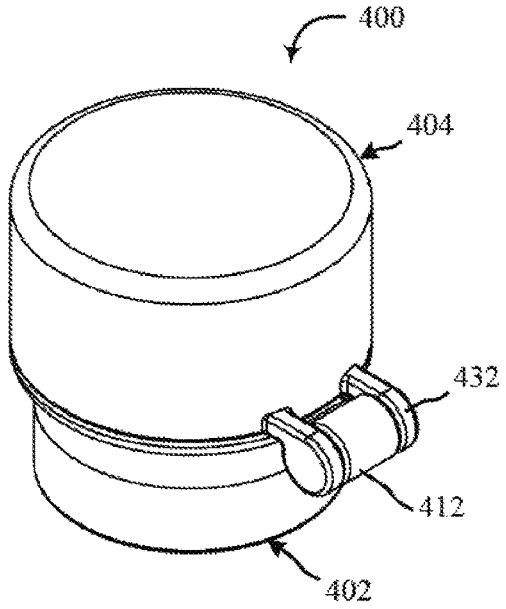
FIG. 4B is a perspective view of the universal fit bottle cap shown in FIG. 4A in a closed position.
Figure 5A:
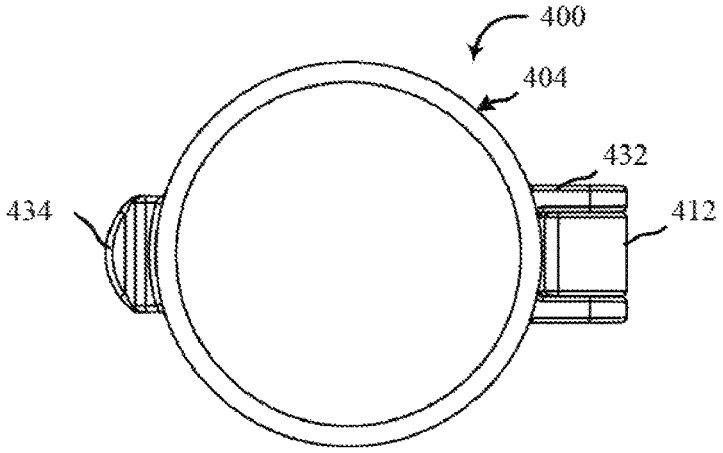
FIG. 5A is a top view of the universal fit bottle cap shown in FIG. 4B.
Figure 5B:
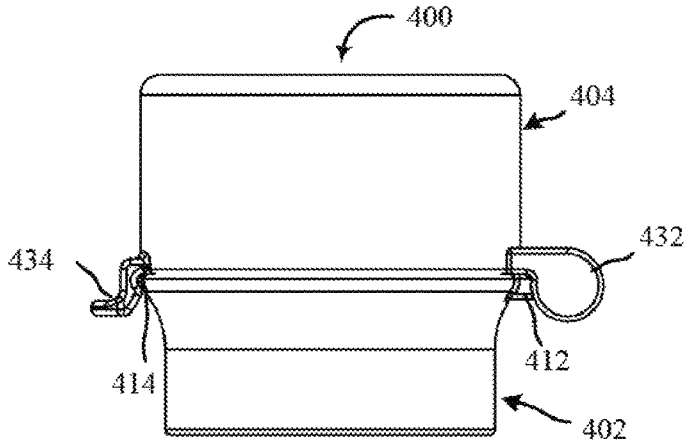
FIG. 5B is a side view of the universal fit bottle cap shown in FIG. 4B.
Figure 5C:
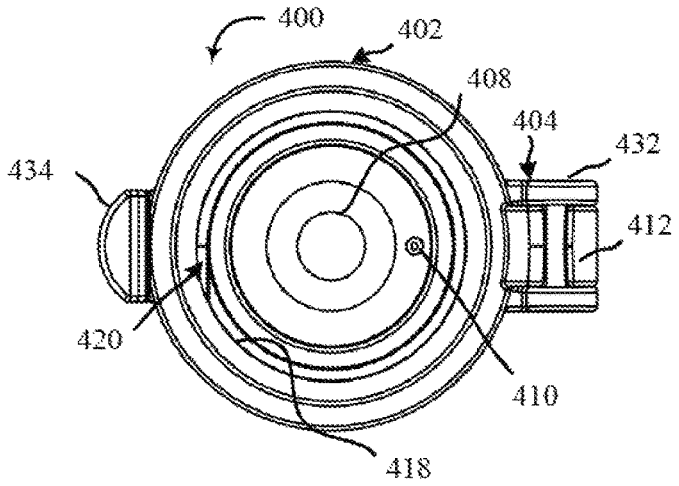
FIG. 5C is a bottom view of the universal fit bottle cap shown in FIG. 4B.
Figure 6A:
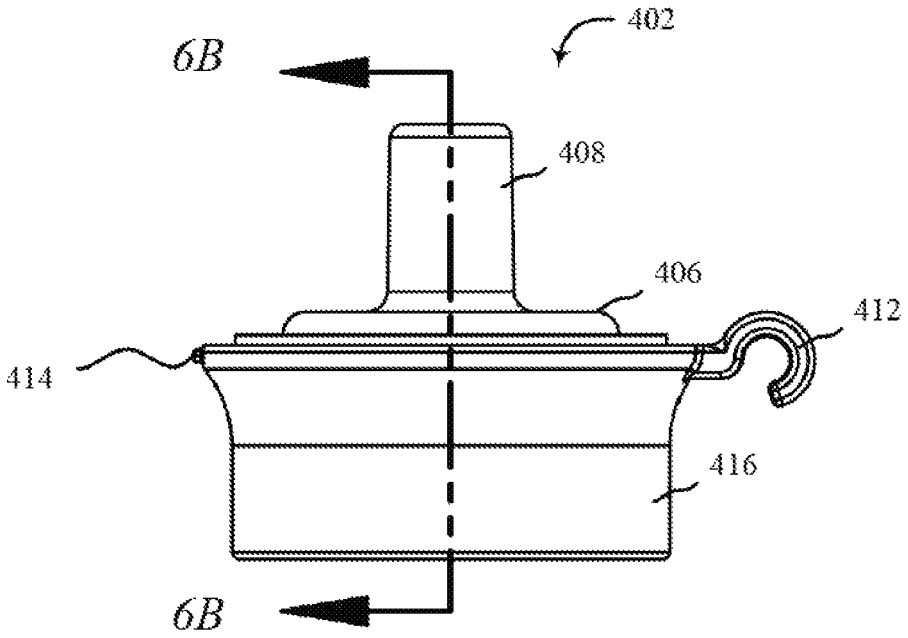
FIG. 6A is a side view of the universal fit bottle cap shown in FIG. 4A with a lid portion removed.
Figure 6B:
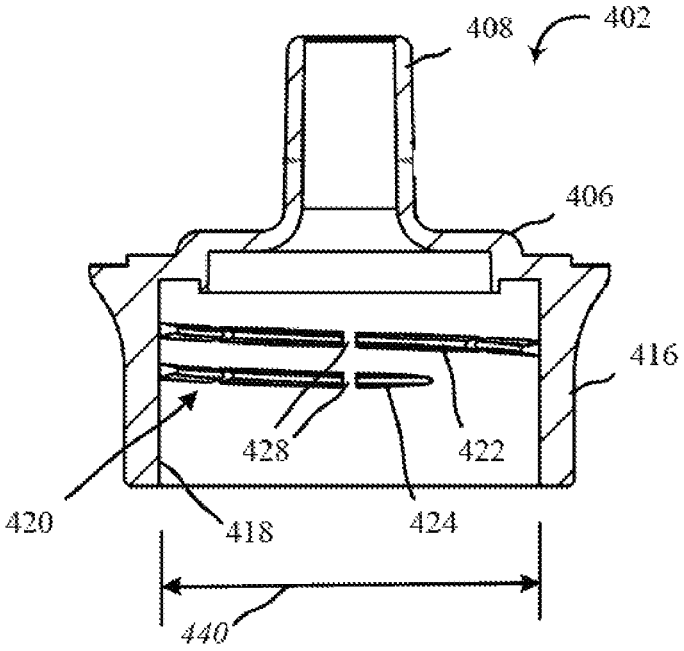
FIG. 6B is a cross-sectional view of the universal fit bottle cap shown in FIG. 6A taken along cross-section indicators 6B-6B.

Base portion 402 includes a top surface 406, a nozzle 408, a breather hole 410, a base pivot connector 412, a base latch member 414, and a skirt 416, as shown in FIGS. 4A and 4B. FIG. 6B also shows the base portion 402 including an inner surface 418 of the skirt 416, and a plurality of female threads 420 positioned on the inner surface 418. The female threads 420 may include first and second thread rings 422, 424, and plurality of gaps or ports of entry 428 formed in the thread rings 422, 424. The female threads 420 with ports of entry 428 may provide the same or similar advantages as described above for the universal fit bottle cap 4 and/or adapter 5.

As shown in FIG. 6B, the skirt 416 may have an internal diameter 440 in the range of about 0.5 inches to about 4 inches, and more particularly in the range of about 0.5 inches to about 1.5 inches. The internal diameter 440 may correspond generally to the neck width 16 of a container 6 to which the universal fit bottle cap 400 is mounted.

The lid portion 404 includes an inner cavity 430 sized to accommodate and surround the nozzle 408 when the lid portion 404 is in the closed position shown in FIG. 4B. The lid portion 404 also includes a lid pivot connector 432, a lid latch member 434, a bottom edge surface 436, and a sealing member 438. The lid pivot connector 432 may mate with the base pivot connector 412 to provide a pivot connection between the base and lid portions 402, 404. The lid latch member 434 may releasably mate with the base latch member 414 to provide a releasable connection between the base and lid portions 402, 404 to hold the lid portion 404 in the closed position shown in FIG. 4B. The bottom edge surface 436 may contact the top surface 406 of the base portion 402 and may provide a sealed interface between the base and lid portions 402, 404. The sealing member 438 may be inserted into and/or provide a sealing interface with the breather hole 410 when the lid portion 404 is in the closed position shown in FIG. 4B.

The lid portion 404 may also include a nozzle sealing feature (not shown) positioned on an inner surface (e.g., inner top surface) of the lid portion 404. The nozzle sealing feature may be inserted into and/or provide a sealing interface with the opening into nozzle 408 when the lid portion is in the closed position shown in FIG. 4B. The nozzle sealing feature may include a plug, ridge, lip, protrusion, recess or other structural feature formed on the lid portion 404.

The nozzle 408 may be integrated into the top surface 406 of the base portion 402. Alternatively, the nozzle 408 may be provided as a separate piece, such as in the universal fit bottle cap 4 described with reference to FIGS. 1-3D. The nozzle 408 may be sized and arranged to receive a straw, such as the straw 12 shown in FIG. 1. In some embodiments, the straw 12 of FIG. 1 may be reusable and the straw receivable by nozzle 408 may be disposable. For example, a straw that is reusable may be formed of different material than a straw that is disposable. The universal fit bottle cap 400 may also be used with an adapter, such as the adapter 5 described with reference to FIGS. 1-3D. The universal fit bottle cap 400 may include a washer, such as the washer 19 described with reference to FIG. 1.

The universal fit bottle cap 400 may be operable to connect to containers having a variety of sizes and shapes. In some embodiments, the universal fit bottle cap 400 may provide a releasable connection to neck portions of containers that have a range of width dimensions. In at least some examples, the universal fit bottle cap 400 can fit a range of width dimensions that vary by about 0.01 inches to about 0.25 inches in diameter. Further, the universal fit bottle cap 400 may be operable with a variety of thread sizes, patterns and shapes. In particular, the ports of entry 428 may make it possible for the universal fit bottle cap 400 to be used with at least two different thread shapes, sizes, numbers and/or patterns while providing a liquid tight connection between the container and the universal fit bottle cap 400.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A bottle cap assembly, comprising:

a base portion, comprising:

a top surface;

a skirt portion having an inner surface;

a nozzle extending from the top surface;

a plurality of female threads positioned on the inner surface of the skirt portion;

a plurality of at least four gaps, at least two gaps of the at least four gaps dividing a first ring of thread of the plurality of female threads into separate portions, wherein each gap of the at least four gaps has a gap length and each of the separate portions having a portion length greater than each of the gap length;

wherein the plurality of female threads and the at least four gaps are for attaching at a first time to a first container having a first neck and for separately attaching at a second time different from the first time to a second container having a second neck, wherein the second neck is distinct from the first neck based at least in part on at least one first container male thread of the first neck being distinct from at least one second container male thread of the second neck.

2. The bottle cap assembly of claim 1, further comprising a lid portion pivotally mounted to the base portion, the lid portion, when in a closed position relative to the base portion, enclosing the nozzle.

3. The bottle cap assembly of claim 2, wherein the base portion further comprises a breather hole formed in the top surface.

4. The bottle cap assembly of claim 3, wherein the lid portion includes a sealing member configured to close the breather hole when the lid portion is in the closed position.

5. The bottle cap assembly of claim 2, wherein the lid portion is connected to the base portion with a pivot connection.

6. The bottle cap assembly of claim 2, wherein the lid portion and the base portion include mating snap-fit connection features that are operable to releasably hold the lid portion in the closed position.

7. The bottle cap assembly of claim 1, wherein the nozzle is integrally formed with the top surface.

8. The bottle cap assembly of claim 1, wherein the plurality of female threads include two threads.

9. The bottle cap assembly of claim 1, wherein the skirt portion has an internal diameter in a range of 0.5 inches to 3 inches, and the bottle cap assembly is configured to mount to the necks of the at least two different containers having diameter sizes in the range of 0.5 inches to 3 inches.

10. The bottle cap assembly of claim 1, wherein the skirt portion has an internal diameter in a range of 0.5 inches to 1.5 inches, and the bottle cap assembly is configured to separately mount to the necks of the at least two different containers having diameter sizes in the range of 0.5 inches to 1.5 inches.

11. The bottle cap assembly of claim 1, wherein the nozzle is configured to receive a straw.

12. The bottle cap assembly of claim 11, wherein the straw is comprised of disposable material.

13. A bottle cap assembly, comprising:

a base portion, comprising:

a top surface;

a skirt portion having an inner surface;

an opening formed in the top surface;

a plurality of female threads positioned on the inner surface of the skirt portion and including at least a first ring of thread;

at least four ring gaps comprising at least two first ring gaps formed in the first ring of thread, each of the at least four ring gaps having a gap length and the at least two ring gaps dividing the first ring of thread into separate portions, each separate portion having a portion length greater than each of the gap length, the at least four ring gaps configured to provide attachment to a first container having at least one first male thread and for separately attaching at a different time to a second container having at least one second male thread, wherein the at least one first male thread is distinct from the at least one second male thread.

14. The bottle cap assembly of claim 13, wherein the plurality of female threads include a second ring of thread.

15. The bottle cap assembly of claim 14, wherein the first ring of thread and the second ring of thread comprise different patterns.

16. The bottle cap assembly of claim 14, wherein at least two of the at least four ring gaps are formed along a length of the second ring of thread.

17. The bottle cap assembly of claim 16, wherein at least one of the at least two ring gaps formed in the first ring thread and at least one of the at least two ring gaps formed in the second ring thread are aligned.

18. The bottle cap of claim 14, wherein at least one of the at least two ring gaps of the first ring of thread of the plurality of female threads is configured for entry of the at least one first male thread, and the other of the at least two ring gaps of the second ring of thread of the plurality of female threads for entry of the of the second male thread.

* * * * *